US009072924B2

(12) United States Patent
Capsius

(10) Patent No.: US 9,072,924 B2
(45) Date of Patent: Jul. 7, 2015

(54) PREACTION DRY PIPE ALARM VALVE FOR A SPRINKLER PIPEWORK

(75) Inventor: Christian Capsius, Rümpel (DE)

(73) Assignee: MINIMAX GMBH & CO. KG, Bad Oldesloe (DE)

( * ) Notice: Subject to any disclaimer, the term of this patent is extended or adjusted under 35 U.S.C. 154(b) by 301 days.

(21) Appl. No.: 13/278,732

(22) Filed: Oct. 21, 2011

(65) Prior Publication Data

US 2013/0098641 A1 Apr. 25, 2013

(51) Int. Cl.

| | |
|---|---|
| ***A62C 35/00*** | (2006.01) |
| ***A62C 37/36*** | (2006.01) |
| ***A62C 37/10*** | (2006.01) |
| ***A62C 35/62*** | (2006.01) |
| ***A62C 35/64*** | (2006.01) |
| ***A62C 35/68*** | (2006.01) |
| ***A62C 37/44*** | (2006.01) |

(52) U.S. Cl.

CPC ..... *A62C 35/62* (2013.01); *A62C 35/64* (2013.01); *A62C 35/645* (2013.01); *A62C 35/68* (2013.01); *A62C 37/44* (2013.01)

(58) Field of Classification Search

CPC ..... A62C 35/62; A62C 35/68; A62C 37/44
USPC ..... 169/17, 19–22; 137/467, 527, 527.8, 137/551

See application file for complete search history.

(56) References Cited

U.S. PATENT DOCUMENTS

| | | | | |
|---|---|---|---|---|
| 2,352,996 | A * | 7/1944 | Rider | 169/17 |
| 3,589,445 | A * | 6/1971 | Juliano | 169/17 |
| 5,720,351 | A * | 2/1998 | Beukema et al. | 169/61 |
| 5,971,080 | A * | 10/1999 | Loh et al. | 169/43 |
| 5,992,532 | A * | 11/1999 | Ramsey et al. | 169/46 |
| 6,848,513 | B2 | 2/2005 | Jackson et al. | |
| 7,185,711 | B2 * | 3/2007 | Jackson et al. | 169/46 |
| 7,383,892 | B2 | 6/2008 | Jackson | |

(Continued)

FOREIGN PATENT DOCUMENTS

| | | | |
|---|---|---|---|
| DE | 4320442 | * 12/1994 | A62C 37/08 |
| DE | 202010016720 U1 | 4/2011 | |

OTHER PUBLICATIONS

Tyco Fire Suppression & Building Products; Model QRS Electronic Accelerator (Quick Opening Device) for Dry Pipe or Preaction Systems; TFP1100; May 2009 (pp. 1-16).

*Primary Examiner* — Len Tran

*Assistant Examiner* — Alexander Valvis

(74) *Attorney, Agent, or Firm* — Harness, Dickey & Pierce, P.L.C.

(57) ABSTRACT

A preaction dry pipe alarm valve (1) is provided for a sprinkler pipework (24) and sprinklers with a fire detection and extinguishing control panel (26). A water supply (38 and an air feed (37) are selectively in communication with the sprinkler pipework. A pilot control chamber (19) of the preaction dry pipe alarm valve (1) is depressurized in case of a fault message from the fire detection and extinguishing control panel (26). When the pilot control chamber (19) is depressurized and, in the case of a decreasing pressure in the sprinkler pipework (24), a quick opener (40) opens the valve head (2) of the preaction dry pipe alarm valve (1), so that extinguishing water can flow into the dry pipework (24). The system allows very short flooding times for the sprinkler pipework with no additional rapid vents installed in the pipework.

6 Claims, 2 Drawing Sheets

(56) References Cited

U.S. PATENT DOCUMENTS

Figure 1:
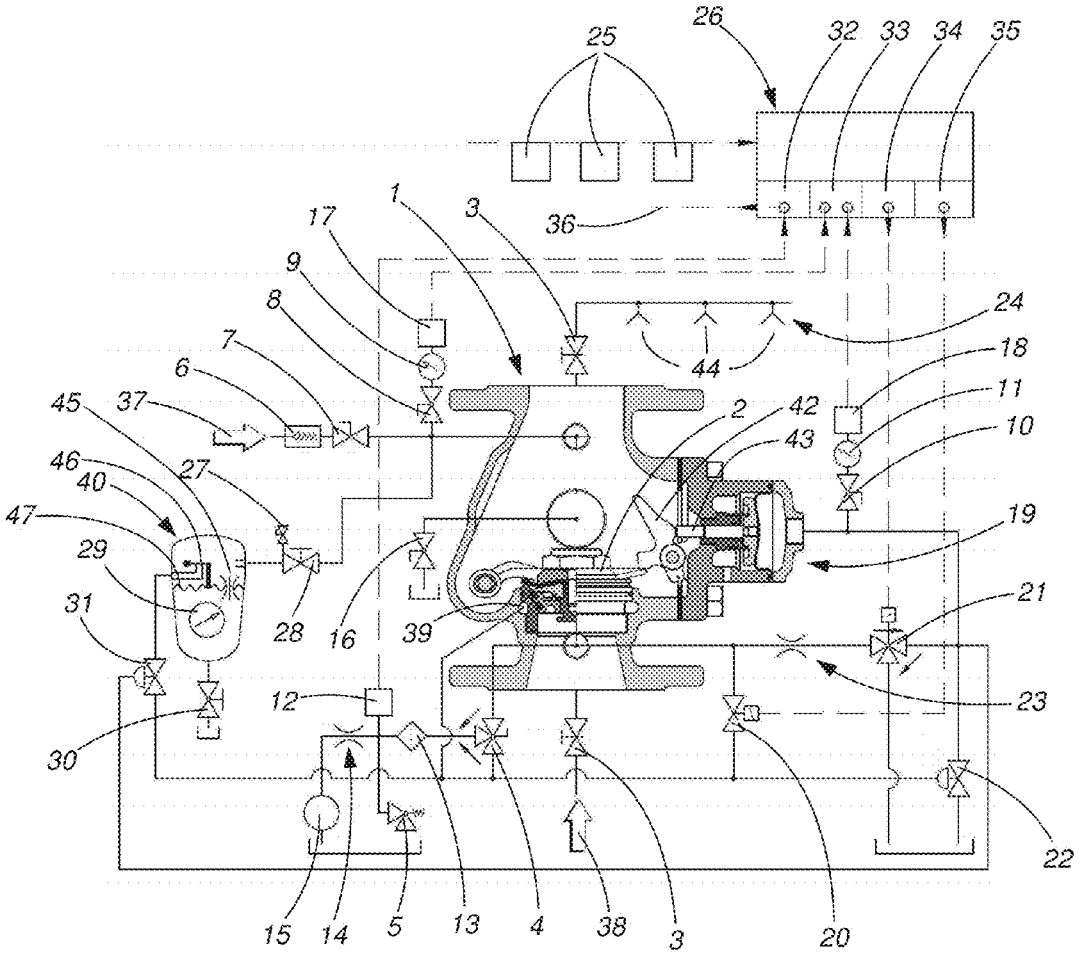

| | | | | |
|---|---|---|---|---|
| 7,389,824 | B2 | 6/2008 | Jackson | |
| 7,543,653 | B2 * | 6/2009 | Reilly et al. | 169/17 |
| 7,857,069 | B2 * | 12/2010 | Yu | 169/46 |
| 2006/0090908 | A1 | 5/2006 | Jackson et al. | |
| 2007/0289751 | A1 * | 12/2007 | Feenstra et al. | 169/16 |
| 2008/0105440 | A1 | 5/2008 | Jackson et al. | |
| 2008/0277125 | A1 * | 11/2008 | Wilkins et al. | 169/46 |
| 2009/0272549 | A1 | 11/2009 | Feenstra et al. | |
| 2009/0288846 | A1 | 11/2009 | Leblanc | |
| 2010/0181082 | A1 | 7/2010 | Green | |
| 2011/0056709 | A1 | 3/2011 | Feenstra | |
| 2012/0067430 | A1 * | 3/2012 | Deperraz et al. | 137/1 |

* cited by examiner

PREACTION DRY PIPE ALARM VALVE FOR A SPRINKLER PIPEWORK

FIELD

The invention relates to a preaction dry pipe alarm valve for a sprinkler pipework.

BACKGROUND

Dry valve stations are used to separate the water supply from the dry pipework as well as for issuing an alarm in case of a release. Dry pipeworks are used particularly in cases where the pipework cannot be filled with water because there is a risk of freezing. These pipeworks are generally filled with pressurized air. In case of a fire, the pipework must be vented rapidly, and filled with extinguishing water. Quick action venting stations are used for this purpose.

Simple quick action venting stations have been known and used for a long time. Thus DE 100 15 030 A1 describes a quick action venting valve for rapidly venting pipe systems of sprinkler installations in case of fire, in which a solenoid valve is arranged in the area of the control line leading to the diaphragm chamber of the quick opener, whereby the diaphragm chamber and thus the control chamber on the solenoid valve are unloaded by a direct pathway, which makes it possible to vent the sprinkler pipework more quickly.

Another solution for quick venting of a sprinkler installation is described in DE 199 36 454 A1 with a method for operating a sprinkler installation in a cold room, wherein the extinguishing valve is controlled by a release valve which is readjusted by the fire detection panel, in such a manner that the extinguishing valve opens the path for the liquid extinguishing medium into the feed line only if due to open sprinklers the gas pressure in the feed line is reduced and additionally the release valve opens.

An electrically controlled quick action vent for a dry pipework with sprinklers is also described in DE 10 2007 049 588 A1, wherein, on the dry pipework with sprinklers and dry pipe alarm valve, a solenoid valve is arranged, which is released by means of an extinguishing control panel and a pressure switch. The solution has the advantage that dry sprinkler networks can be vented rapidly and reliably even in case of foam admixtures with extinguishing water and the presence of remainders of extinguishing water, until the entire pipework is filled with extinguishing agent.

In special cases, preaction dry valve stations are used for quick opening of the pipes. A preaction dry installation controlled with this dry valve station represents a combination fire detection and sprinkler installation. It prevents the outflow of water in case of accidental damage to a sprinkler. For extinguishing water to be able to flow out of these dry installations, the fire detection installation must respond in addition.

Preaction dry stations, when actuated by a fire detection installation, must open, and release the water flow at the latest 15 s after actuation. If a sprinkler opens without actuation by the fire detection installation, the preaction dry station must not release the water flow. A pressure decrease in the dry pipework must continue to be reported. If the fire detection installation fails, or has a fault, the station must by switched over via a solenoid valve that is open without electricity, in such a way that it opens in case of dropping air pressure in the sprinkle pipework, i.e., in such a manner that it is analogous to a dry station in term of its function. The ratio of water pressure to air pressure (opening pressure) must be at least 5:1. The operating air pressure in the sprinkler pipework should be at most 3.5 bar.

In cases where the station is switched over in such a manner that it opens in case of dropping air pressure in the sprinkler pipework, i.e., it is switched over to pressure dependent operation, the air must escape through the opened sprinkler from the pipework until the air pressure has dropped to ⅕ of the supply pressure, so that the pipework is flooded, and water can reach the sprinkler. If the pipeworks are sufficiently large, this can take relatively long, which delays the extinguishing process.

Previous solutions to flood the pipework consisted in installing so-called quick action vents at the end of the pipework. In case of a pressure drop in the pipework, they open and allow air to escape from the pipework over a larger cross section. As a result, a more rapid pressure drop is achieved, which reduces the time until the opening pressure (⅕ of the supply pressure) is reached. From this time on, the pipework is then flooded DE 43 20 442 A1 describes a generic dry pipe alarm valve with a quick opener, which is connected to the preaction dry pipe alarm valve when the preaction chamber is depressurized, and which, in the case of a decreasing pressure in the sprinkler pipework, opens the valve head of the dry pipe alarm valve, so that extinguishing water can flow into the dry pipework.

These installations have the disadvantage that, in addition, a quick action vent has to be installed in the pipework, and long flooding times are required to release the sprinklers.

SUMMARY

The problem of the invention therefore is to provide an installation and a method by means of which a short release time of the dry valve is achieved, in the case of a preaction dry pipe alarm valve which has switched over to the depressurized range.

This problem is solved by a preaction dry pipe alarm valve (1) for a sprinkler pipework (24) with sprinklers with a fire detection and extinguishing control panel (26), a water supply (38), valves, and an air feed (37), wherein a pilot control chamber (19) of the preaction dry pipe alarm valve (1) is depressurized in case of a fault message from the fire detection and extinguishing control panel (26), a quick opener (40) which is in connection with the preaction dry pipe alarm valve (1), when the pilot control chamber (19) is depressurized and, in the case of a decreasing pressure in the sprinkler pipework (24), opens the valve head (2) of the preaction dry pipe alarm valve (1), so that extinguishing water can flow into the dry pipework (24), characterized in that the quick opener (40) is connected to an annular channel (39) of the preaction dry pipe alarm valve (1) via pipes, and, in the case of a decreasing pressure in the sprinkler pipework (24), releases air into the annular channel (39), so that the valve head (2) of the water supply (38) for the sprinkler pipework (24) is opened.

The preaction dry pipe alarm valve for a sprinkler pipework with sprinklers comprises a fire detection and extinguishing control panel, the water supply, valves, the air feed as well as a pilot control chamber which is depressurized, in case of a fault message from the fire detection and extinguishing control panel.

To reduce the release time of the preaction dry pipe alarm valve, a quick opener is arranged on the preaction dry pipe alarm valve in such a manner that its function is activated only when the station is switched over to the pressure dependent operation, which means when a fault message from the fire detection and extinguishing control panel is present. The quick opener on the preaction dry pipe alarm valve is connected to the sprinkler pipework, it directly and rapidly registers a pressure drop in the sprinkler pipework, and it reduces the ratio of the opening pressure of the preaction dry pipe alarm valve.

The quick opener is advantageously a diaphragm quick opener with a diaphragm, a throttle, a pressure gauge and a valve flap.

Furthermore, the quick opener is in connection with the annular channel of the dry pipe alarm via pipes, and it is switched in such a manner that, when the pressure decreases in the sprinkler pipework, it releases air into the annular channel, so that the valve head of the water supply for the sprinkler pipework is opened, and immediate flooding of the sprinkler pipework occurs.

Furthermore, it is advantageous that, between the quick opener and the annular channel, a diaphragm valve is arranged, which is opened when the station is switched over to the pressure dependent operation.

The opening of the diaphragm valve is carried out via a 3/2-way valve, which is controlled by the fire detection and extinguishing control panel. The 3/2-way valve may advantageously be a solenoid valve, the control of which is carried out by the fire detection and extinguishing control panel.

Instead of the diaphragm valve, it may also be advantageous to replace said valve with a 2/2-way solenoid valve that is open without electricity, and to arrange it between the quick opener and the annular channel, the latter valve being actuated in parallel with the 3/2-way solenoid valve.

The solution according to the invention has the advantage that no additional rapid vents need to be installed in the pipework, which allows achieving very short flooding times for the sprinkler pipework.

DRAWINGS

Figure 2:
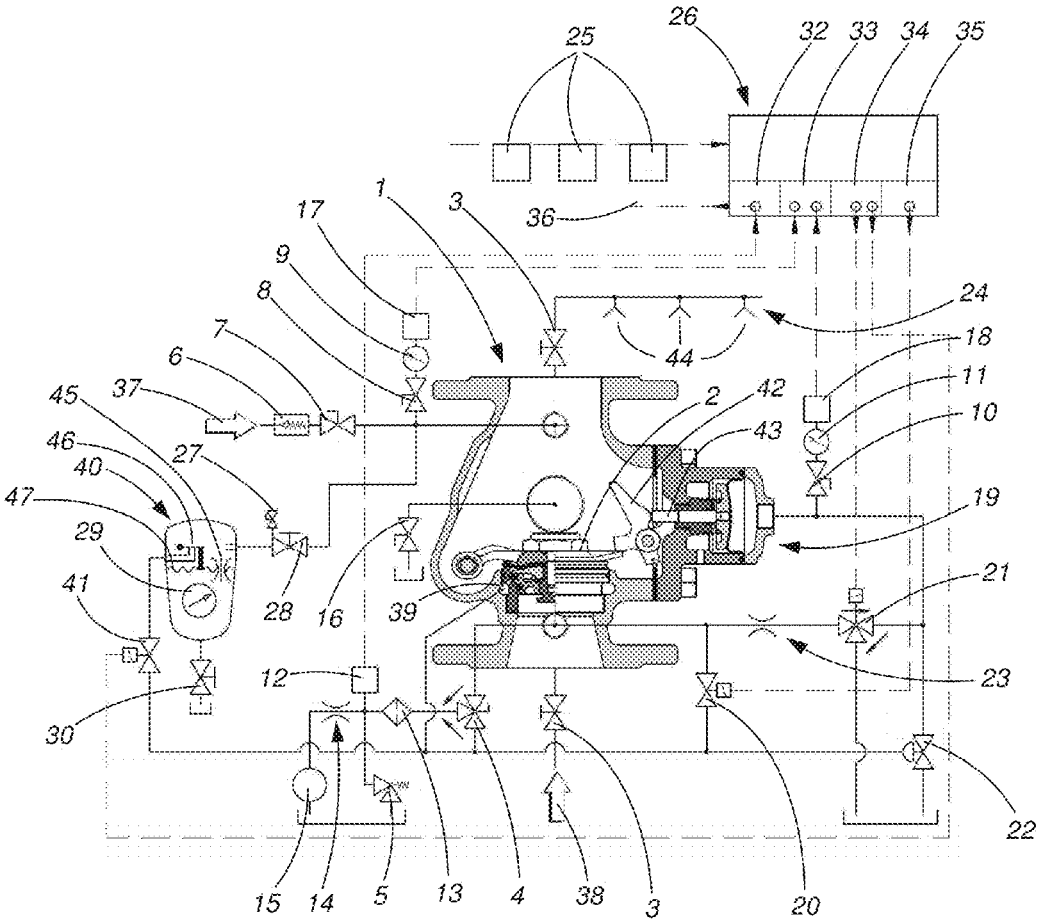

Below, the invention is explained further in reference to an embodiment example and two figures. The figures show:

FIG. 1 is a diagrammatic representation of a preaction dry pipe alarm valve for a sprinkler pipework; and FIG. 2 is a diagrammatic representation of a preaction dry pipe alarm valve for a sprinkler pipework.

DETAILED DESCRIPTION

FIG. 1 shows a diagrammatic representation of a preaction dry pipe alarm valve 1 for a sprinkler pipework 24, wherein a first gate valve 3 is arranged between the sprinkler pipework 24 and the dry pipe alarm valve 1. The valve head 2 forms the separation between the water supply 38 and sprinkler pipework 24. The water supply 38 to the preaction dry pipe alarm valve 1 can be interrupted by a second gate valve 3 upstream of the dry pipe alarm valve 1. The sprinkler pipework 24 is filled with pressurized air via the air feed 37, wherein the operating air pressure in the sprinkler pipework 24 should be at most 3.5 bar. The air feed 37 includes a one-way check valve 6 and a ball valve 7 that allows the air feed line 37 to be closed off. A manual gate valve 8 is connected to the air feed and supplies air to a sprinkler pipework pressure gauge 9. A sprinkler pipework monitoring pressure switch 17 is in communication with the airfeed 37 and provides a monitoring signal 33 to the control panel 26.

The preaction control of the dry pipe alarm valve 1 is carried out by the pilot control 19, which exerts, via a push rod 43, a pressure on the lever 42 to the right of the valve head 2. The supply line to the pilot control 19 includes a manual ball valve 10 that connects to a pilot control/water supply pressure gauge 11. A pilot control/water supply monitoring pressure switch 18 is in communication with the pilot control supply line and provides a monitoring input signal 33 to the control panel 26. This pilot control 19 prevents extinguishing due to accidental damage to a sprinkler 44, which results in a gradual pressure drop in the sprinkler pipework 24. The control of the installation is carried out by the fire detection and extinguishing control panel 26, which carries out the release 35 via opening the 2/2-way release solenoid valve 20, at the time of the fire event message via the fire detector 25. If a fault 34 is registered in the fire detection and extinguishing control panel 26, the pilot control 19 is depressurized via the 3/2-way pilot control solenoid valve 21. As a result of this pressure drop, the diaphragm valve 31 is opened, opening the path from the quick opener 40 to the annular/alarm channel 39. The quick opener 40 includes a throttle 45, a valve flap 46 and a diaphragm 47. Through the quick opener 40, a pressure drop in the sprinkler pipework 24 can be registered constantly. In case of a fault message from the fire detection and extinguishing control panel 26, the diaphragm valve 31 is opened. A pressure drop in the sprinkler pipework 24 now has the effect that air flows out of the quick opener 40 via the diaphragm valve 31 and the subsequent pipe flows into the annular/alarm channel 39 of the dry pipe alarm valve 1, and opens the valve head 2 immediately, so that the extinguishing water 38 can flow immediately into the sprinkler pipework 24. A diaphragm valve 22 is provided for the safe pressure relief of the control chamber 19 when the 2/2-way release solenoid valve 20 is triggered regardless of the state of the 3/2-way pilot control solenoid valve 21.

A 3/2-way ball valve 4 can be in communication with the water supply 38 and allows an alarm to be switched off after the pre-action dry pipe alarm valve 1 has been opened, and to carry out an alarm test without opening the pre-action dry pipe alarm 1. The 3/2-way ball valve 4 uses an operation position, an alarm off position, and an alarm test position.

When the 3/2-way ball valve 4 is in the operating position, a passage exists from the annular/alarm channel 39 via the strainer 13 to the alarm pressure switch 12 and via the throttle 14 of the alarm pipe 14 to the alarm gong 15. The alarm pressure switch provides an "alarm" control input signal 32 to the control panel 26. The control panel 26 includes a line 36 to a manifold detector.

In the off-position, the passage to the alarm pressure switch 12 and the alarm gong 15 is blocked. After opening of the alarm valve 1, the alarm can be deactivated by means of the alarm gong 15 and the alarm pressure switch 12 by turning the 3/2-way ball valve 4 to the off-position.

When the 3/2-way ball valve 4 is in the test position, the passage from the water supply 38 to the alarm pressure switch 12 and to the alarm gong 15 is released. In this position, the alarm can be checked by means of the alarm pressure switch 12 and the alarm gong 15 without any opening of the preaction pipe alarm valve 1. The system can be provided with a series of drain valves that allow the sprinkler pipework 24 and other components to be drained for resetting the system. In particular, ball valves 16, 30 and drain valve 5 can be used to drain the system.

FIG. 2 shows the preaction dry pipe alarm valve 1 for a sprinkler pipework 24 with a 2/2-way solenoid valve 41 that is open without electricity, arranged between the quick opener 40 and the annular/alarm channel 39, wherein the 2/2-way solenoid valve 41 is actuated in parallel with the 3/2-way solenoid valve 21.

The invention claimed is:

1. A preaction dry pipe fire protection sprinkler system, comprising;

a sprinkler pipework (24) with a plurality of sprinklers (44);

a water supply;

a preaction dry pipe alarm valve (1) connected to the sprinkler pipework (24) and to the water supply, the preaction dry pipe alarm valve including a valve head (2), a pilot control chamber (19) and an annular channel (39) disposed in communication with the valve head (2);

a fire detection and extinguishing control panel (26);

an air feed (37) connected to the sprinkler pipework (24);

wherein the pilot control chamber (19) is pressurized by the water supply pressure, the pilot control chamber (19) secures the valve head (2) of the preaction dry pipe alarm valve in a closed position;

a quick opener (40) in connection with the preaction dry pipe alarm valve (1), wherein the quick opener (40) is activated only when the pilot control chamber (19) is depressurized in the case of a fault message from the fire detection and extinguishing control panel (26), the fault message being indicative that a failure is detected by the fire detection and extinguishing control panel;

wherein the quick opener (40) is connected to the annular channel (39) of the preaction dry pipe alarm valve (1) via pipes, and in the case of the pilot control chamber (19) is depressurized due to the fault message from the fire detection and extinguishing control panel and a decreasing pressure in the sprinkler pipework (24), the quick opener (40) releases air into the annular channel (39), so that the valve head (2) is opened so that extinguishing water from the water supply (38) can flow into the dry pipework (24).

2. The preaction dry pipe fire protection sprinkler system according to claim 1, wherein the quick opener (40) is a diaphragm quick opener with a diaphragm (47), a throttle (42), a pressure gauge (29) and a valve flap (46).

3. The preaction dry pipe fire protection sprinkler system according to claim 1, wherein between the quick opener (40) and the annular channel (39), a diaphragm valve (31) is arranged, which is open in case of a fault message from the fire detection and extinguishing control panel (26).

4. The preaction dry pipe fire protection sprinkler system according to claim 3, wherein the opening of the diaphragm valve (31) occurs via a 3/2-way valve (21) which is controlled by the fire detection and extinguishing control panel (26).

5. The preaction dry pipe fire protection sprinkler system according to claim 4, wherein a normally open 2/2-way solenoid valve (41) is arranged between the quick opener (40) and the annular channel (39) and is actuated along with a 3/2-way solenoid valve (21).

6. The preaction dry pipe fire protection sprinkler system according to claim 5, wherein the control of the normally open 2/2-way solenoid valve (41) occurs by the fire detection and extinguishing control panel (26).

* * * * *

UNITED STATES PATENT AND TRADEMARK OFFICE

CERTIFICATE OF CORRECTION

PATENT NO. : 9,072,924 B2
APPLICATION NO. : 13/278732
DATED : July 7, 2015
INVENTOR(S) : Christian Capsius It is certified that error appears in the above-identified patent and that said Letters Patent is hereby corrected as shown below:

In the Specification:

At column 3, line number 62, delete “airfeed” and insert --air feed-- therefor.

At column 4, line number 35, delete “pre-action” and insert --preaction-- therefor.

At column 4, line number 36, delete “pre-action” and insert --preaction-- therefor.

In the Claims:

At column 6, claim 2, line number 9, delete “(42)” and insert --(45)-- therefor.

Signed and Sealed this
Second Day of February, 2016

Michelle K. Lee

Michelle K. Lee
*Director of the United States Patent and Trademark Office*